US010760317B2

(12) United States Patent
Guelck

(10) Patent No.: US 10,760,317 B2
(45) Date of Patent: Sep. 1, 2020

(54) CASEMENT WINDOW OPERATOR

(71) Applicant: PLY GEM INDUSTRIES, INC., Cary, NC (US)

(72) Inventor: Volker Guelck, Calgary (CA)

(73) Assignee: PLY GEM INDUSTRIES, INC., Cary, NC (US)

( * ) Notice: Subject to any disclaimer, the term of this patent is extended or adjusted under 35 U.S.C. 154(b) by 197 days.

(21) Appl. No.: 16/007,684

(22) Filed: Jun. 13, 2018

(65) Prior Publication Data

US 2019/0383069 A1 Dec. 19, 2019

(51) Int. Cl.

| | |
|---|---|
| ***E05F 11/16*** | (2006.01) |
| ***E05F 11/14*** | (2006.01) |
| ***E05C 17/24*** | (2006.01) |
| ***E05C 17/50*** | (2006.01) |

(52) U.S. Cl.

CPC ..... *E05F 11/16* (2013.01); *E05C 17/24* (2013.01); *E05C 17/505* (2013.01); *E05F 11/14* (2013.01)

(58) Field of Classification Search

CPC ..... E05F 11/16; E05F 11/10; E05D 15/50; E05D 15/507; E05D 15/505; E05D 15/48; E05D 15/28; E05D 11/1014; E05D 7/02; E05Y 2900/148; E05C 9/021; E05C 17/24; E05C 17/505; E06B 3/50

See application file for complete search history.

(56) References Cited

U.S. PATENT DOCUMENTS 1,724,011 A * 8/1929 Flagg ..... E05F 11/16 49/300
2,040,332 A * 5/1936 Pomeroy ..... E05D 15/50 49/193
2,114,645 A * 4/1938 Van Benschoten ..... E05F 11/14 49/279
2,505,912 A * 5/1950 Reynaud ..... E05F 11/16 49/324
3,103,351 A * 9/1963 Ahlgren ..... E05F 11/10 49/252
3,117,351 A * 1/1964 Ahlgren ..... E05F 11/10 49/252
3,728,818 A * 4/1973 Lovett ..... E06B 3/34 49/192
4,059,924 A * 11/1977 Bierlich ..... E05D 15/48 49/192
5,487,238 A * 1/1996 Eikmeier ..... E05F 11/16 49/279
5,636,476 A * 6/1997 Eikmeier ..... E05F 11/16 49/246

(Continued)

*Primary Examiner* — Justin B Rephann
(74) *Attorney, Agent, or Firm* — Lathrop GPM, LLP

(57) ABSTRACT

A window operator for repositioning a window sash within a window frame. The window operator includes a crank handle for rotating a shaft with a pinion gear. The pinion gear operably engages with a rack containing cutouts, the rack having oppositely disposed first and second ends. The rack is translatable within a track disposed within the window frame. The window operator also includes an operator arm connectable between a first end of the rack and the sash wherein rotation of the shaft by the handle imparts movement to the rack and the operator arm, the rack and operator arm movement capable of transitioning the sash between a window open and a window closed position.

19 Claims, 7 Drawing Sheets

(56) References Cited

U.S. PATENT DOCUMENTS

| | | | | |
|---|---|---|---|---|
| 6,598,346 | B1 * | 7/2003 | Ohman | E05C 9/043 49/390 |
| 6,782,661 | B2 * | 8/2004 | Manzella | E05F 11/16 49/192 |
| 7,036,274 | B2 * | 5/2006 | Carrier | E05C 9/021 292/160 |
| 7,237,811 | B1 * | 7/2007 | Lawrence | E05B 17/0012 292/172 |
| 9,003,706 | B2 * | 4/2015 | Meves | E05F 9/00 49/246 |
| 2002/0124468 | A1 * | 9/2002 | Manzella | E05F 11/16 49/336 |
| 2003/0079414 | A1 * | 5/2003 | Rangabasyam | E05C 9/02 49/395 |
| 2004/0216381 | A1 * | 11/2004 | Clavet | E05F 11/10 49/342 |
| 2005/0198905 | A1 * | 9/2005 | Carrier | E05C 9/021 49/394 |
| 2006/0150561 | A1 * | 7/2006 | Van Klompenburg | E05C 17/24 52/633 |
| 2006/0254150 | A1 * | 11/2006 | Van Kirk | E06B 3/325 49/397 |
| 2017/0107750 | A1 * | 4/2017 | Carrier | E05F 11/16 |
| 2018/0163450 | A1 * | 6/2018 | Erickson | E05F 11/10 |

* cited by examiner

CASEMENT WINDOW OPERATOR

TECHNICAL FIELD

The present disclosure relates to an improved operator for a casement window.

BACKGROUND

A casement is a window that is attached to its frame by one or more hinges at the side. They are used singly, in pairs or even in greater numbers within a common frame, in which case they are hinged on the outside. Casement windows have a single sash, which is hinged on the side and cranks open on a metal track. The sash opens with the turn of a handle, making casement windows a great choice for hard-to-reach places, such as over countertops and sinks.

A casement window has a window sash which is moveably mounted within a frame by a pair of hinges mounted between the window frame and the top and bottom of the window sash. Typically, the arrangement is such that a track is configured within the window frame and an operator arm is connectable to the window sash. A hinge member interconnects the track and the sash window with the hinge member being pivotably connected to the sash arm and to the track. The hinge member is pivotably connected to a mounting shoe which is supported and guided for movement lengthwise of the track.

Casement window operators are well known and typically include a hand crank which drives a worm gear arrangement which is connected to an arm or lever which pushes the window sash open. The worm gear assembly includes a gear shaft having the worm at one end thereof with the other end of the gear shaft extending outwardly through the housing to engage a crank. When the crank is turned, the worm causes the worm wheel to rotate thereby causing the sash to pivot on its hinges between open and closed positions.

As previously noted, there are different opening arrangements for casement windows. A first type is a single arm operator which has an arm which pivots about an axis that is fixed with respect to the window frame and worm gear. The remote end of the arm carries a bearing which slides in a track mounted to the underside of the sash. A disadvantage with single arm operators is the torque required to move the sash towards its fully open position.

A second type of casement operator is the split arm variety. A split arm operator includes a second arm which has a pivot point in the middle of the second arm and the remote end of the second arm is secured through a pivotable mounting to a fixed point on the sash. While a split arm operator allows the window to extend to its fully open position, it does present difficulty at the time of the initial opening of the sash.

A third type of window operator is a dual arm operator which has one arm which rotates about a fixed axis and a housing which carries at its far end a bearing to slide in the track mounted to the window sash. There is also a second arm which has a pivot joint and which is secured at its remote end by a pivotable but fixed connection to the sash.

Many of the operators described above are relatively complex and difficult to assemble such that they will function in a reliable manner. A further problem in northern climates is the tendency of the operator to permit infiltration of cold air thus driving up energy costs.

SUMMARY

Disclosed herein is a casement operator that greatly simplifies the mechanism required to open and close a casement window. According to one aspect of the casement operator disclosed herein, there is provided an operator for a window having a window frame and a sash operable between a window closed position in which the sash is received in the frame and a window open position in which the sash is swung outwardly from the frame. The casement operator includes a rack with a first end and a second end. The rack is slidable in a track disposed within the window frame.

The casement operator also includes an operator arm with a first end and a second end, the first end of the operator arm is interchangeably and rotatably connectable to either the first end or the second end of the rack depending upon the desired swing direction of the sash. The second end of the operator arm is rotatably connected to the sash. The casement operator further utilizes a shaft with a first end and a second end and a pinion mounted to the second end of the shaft. The pinion functionally engages with the rack and as the pinion rotates it imparts movement to the rack and the operator arm. The rack and the operator arm movement allow transitioning the sash between the window open and the window closed position.

It is an object of the present invention to provide a window operator which overcomes some of the disadvantages of the prior art.

It further is an object of the casement operator disclosed herein to provide a single operator that can function in either a left or right hand opening window.

It further is an object of the casement operator disclosed herein to reduce the number of operator mechanisms required for nearly all casement windows to a single set of standard components thereby substantially reducing the number of operators that must be inventoried.

It further is an object of the casement operator disclosed herein to substantially streamline the profile of the casement operator handle to minimize interference with window accouterments such as blinds and shades.

Various objects, features, aspects and advantages of the inventive subject matter will become more apparent from the following detailed description of preferred embodiments, along with the accompanying drawings in which like numerals represent like components. The contents of this summary section are provided only as a simplified introduction to the disclosure, and are not intended to be used to limit the scope of the appended claims. The contents of this summary section are provided only as a simplified introduction to the disclosure, and are not intended to be used to limit the scope of the appended claims.

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

Figure 1:
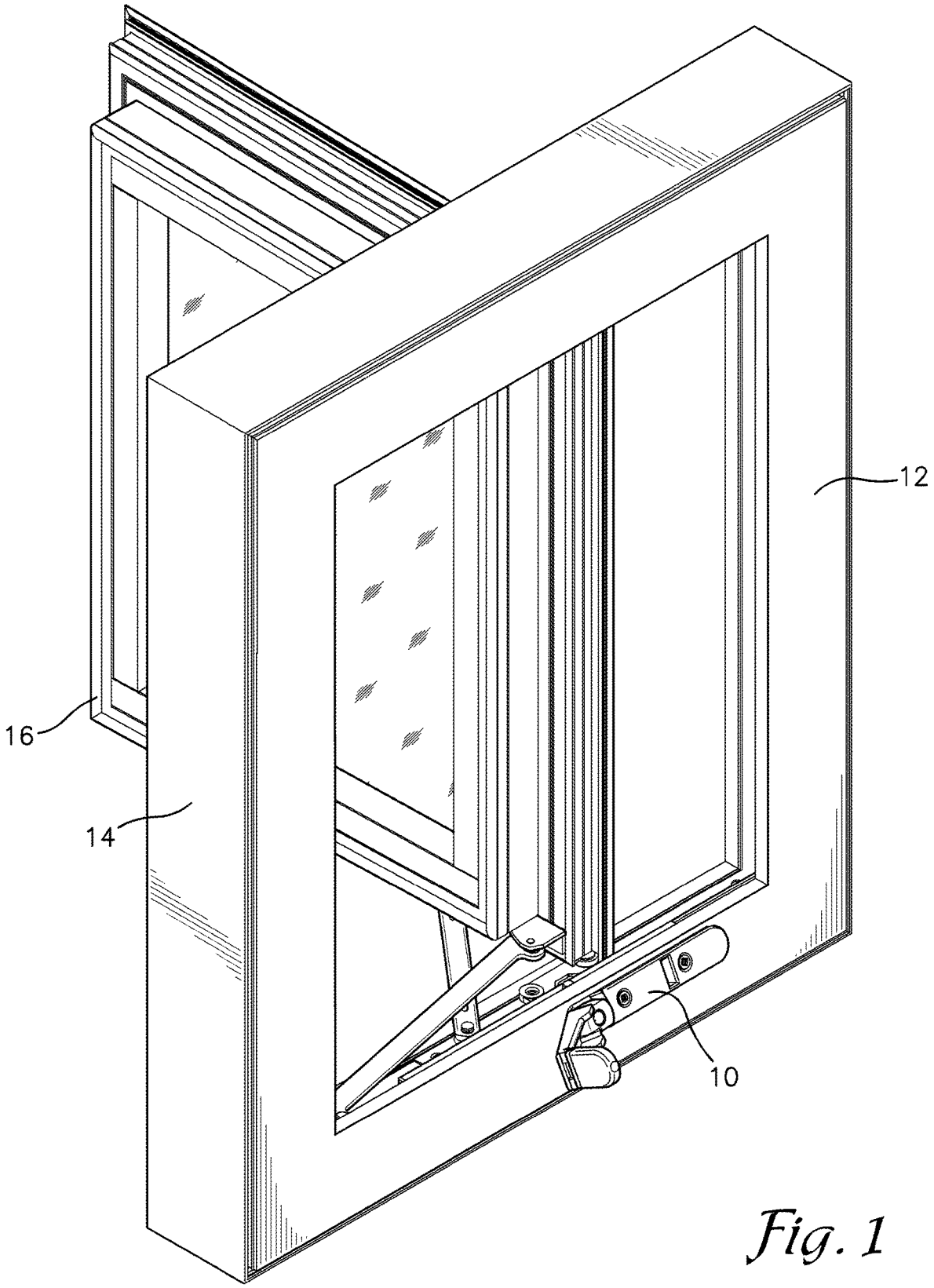
FIG. 1 illustrates a casement window including a frame, a sash and an operator, according to an embodiment.
Figure 2:
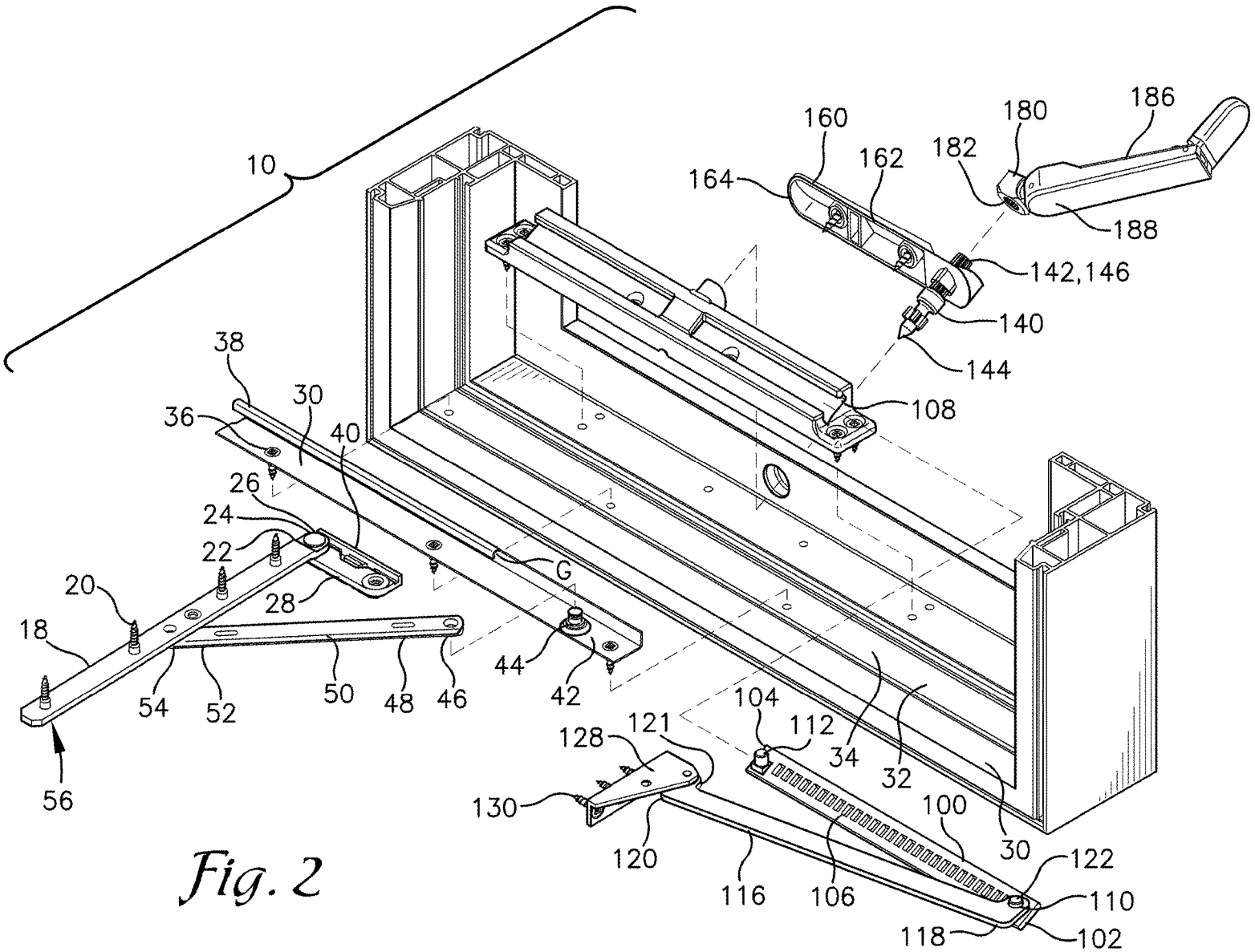
FIG. 2 illustrates an exploded view of casement window operator components, window sash connection hardware and frame features, according to an embodiment.

FIG. 1 reveals a casement operator 10 for a window 12 having a window frame 14 and a sash 16 operable between a window closed position in which the sash 16 is received in the frame 14 and a window open position in which the sash 16 is swung outwardly from the frame 14. As seen in FIG. 2 a hinge arm 18 is mounted to the underside of the sash 16 (not shown in this view) preferably with a plurality of threaded fasteners 20. At a proximal end 22 of the hinge arm 18 is a circular opening 24 that is used to mount the hinge arm 18 to a round boss 26 extending upwardly from a hinge shoe 28. The boss 26 extends upwardly through the opening 24 and the hinge arm 18, as secured to the bottom of the sash 16 is able to rotate about the boss 26 when the sash 16 transitions from an open to a closed position.

The hinge shoe 28 is slidably disposed atop a hinge track 30 which is secured in position within a frame channel 32 that optionally may be formed into the base 34 of the window frame 14. Alternatively, the frame channel 32 may rest atop the frame 14 itself. The hinge track 30 is preferably secured in position within the frame channel 32 by a plurality of threaded fasteners 36 and includes a longitudinally extending overhanging flange 38 that serves to restrain an upwardly extending flange 40 on the hinge shoe 28 in position during translation of the hinge shoe 28 along the hinge track 30. In a preferred embodiment the overhanging flange 38 does not extend the entire span of the hinge track 30 thereby allowing for ready insertion of the upwardly extending flange 40 on the hinge shoe 28 into the gap G resulting from the overhanging flange 38 on the hinge track 30.

At a distal end 42 of the hinge track 30 is a riser 44 that extends upwardly. Mounted upon the riser 44 is an opening 46 in the distal end 48 of a support arm 50. The proximal end 52 of the support arm 50 is pivotally secured at roughly a midpoint 54 of the bottom side 56 of the hinge arm 18.

Figure 3:
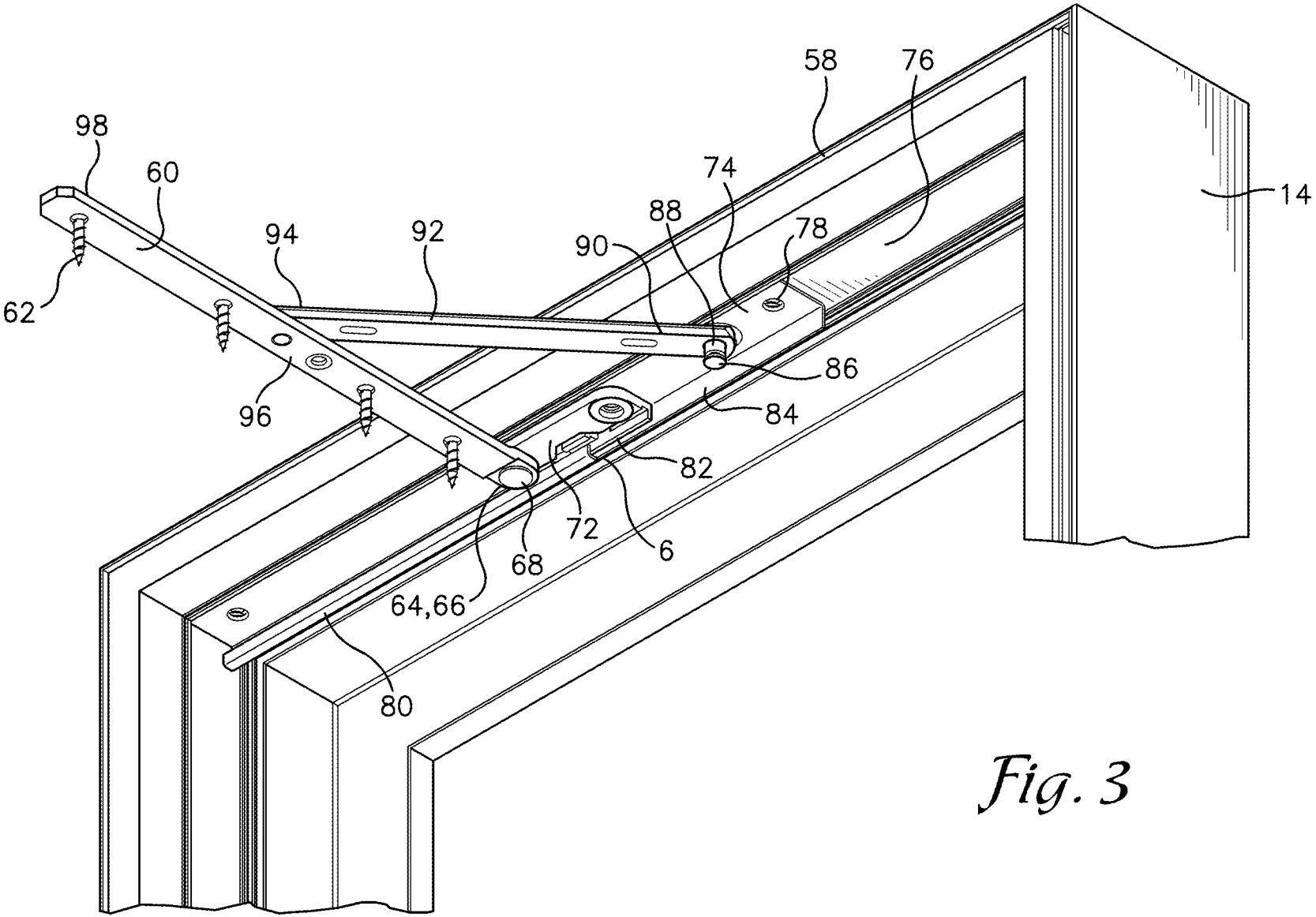
FIG. 3 illustrates a perspective view of the frame of the casement window and hardware for connection to the sash in a window open position, according to an embodiment.

As seen in FIG. 3, the structure at the upper horizontal surface 58 of the frame 14 and sash 16 is comparable to that found at the lower level of the frame 14 and sash 16. An upper hinge arm 60 is mounted to the upper horizontal surface 58 by a plurality of threaded fasteners 62. At a proximal end 64 of the upper hinge arm 60 is a circular opening 66 that is used to mount the upper hinge arm 60 to a round boss 68 extending downwardly from an upper hinge shoe 72. The boss 68 extends downwardly through the opening 66 into the upper hinge arm 60. The upper hinge arm 60 is able to rotate about the boss 68 when the sash 16 transitions from an open to a closed position.

The upper hinge shoe 72 is slidably disposed beneath an upper hinge track 74 which is secured in position within a frame channel 76 formed into the upper cross member 76 of the window frame 14. The upper hinge track 74 is preferably secured in position within the frame channel 76 by a plurality of threaded fasteners 78 and includes a longitudinally extending overhanging flange 80 that serves to restrain a downwardly extending flange 82 on the upper hinge shoe 72 in position during translation of the upper hinge shoe 72 along the upper hinge track 74. In a preferred embodiment the overhanging flange 80 does not extend the entire span of the upper hinge track 74 thereby allowing for ready insertion of the downwardly extending flange 82 on the hinge shoe 72 into the gap G resulting from the overhanging flange 80 on the hinge track 74.

At a distal end 84 of the upper hinge track 74 is a riser 86 that extends downwardly. Mounted over the riser 86 is an opening 88 in the distal end 90 of an upper support arm 92. The proximal end 94 of the upper support arm 92 is pivotally secured at roughly a midpoint 96 of the upper side 98 of the upper hinge arm 60.

Figure 4:
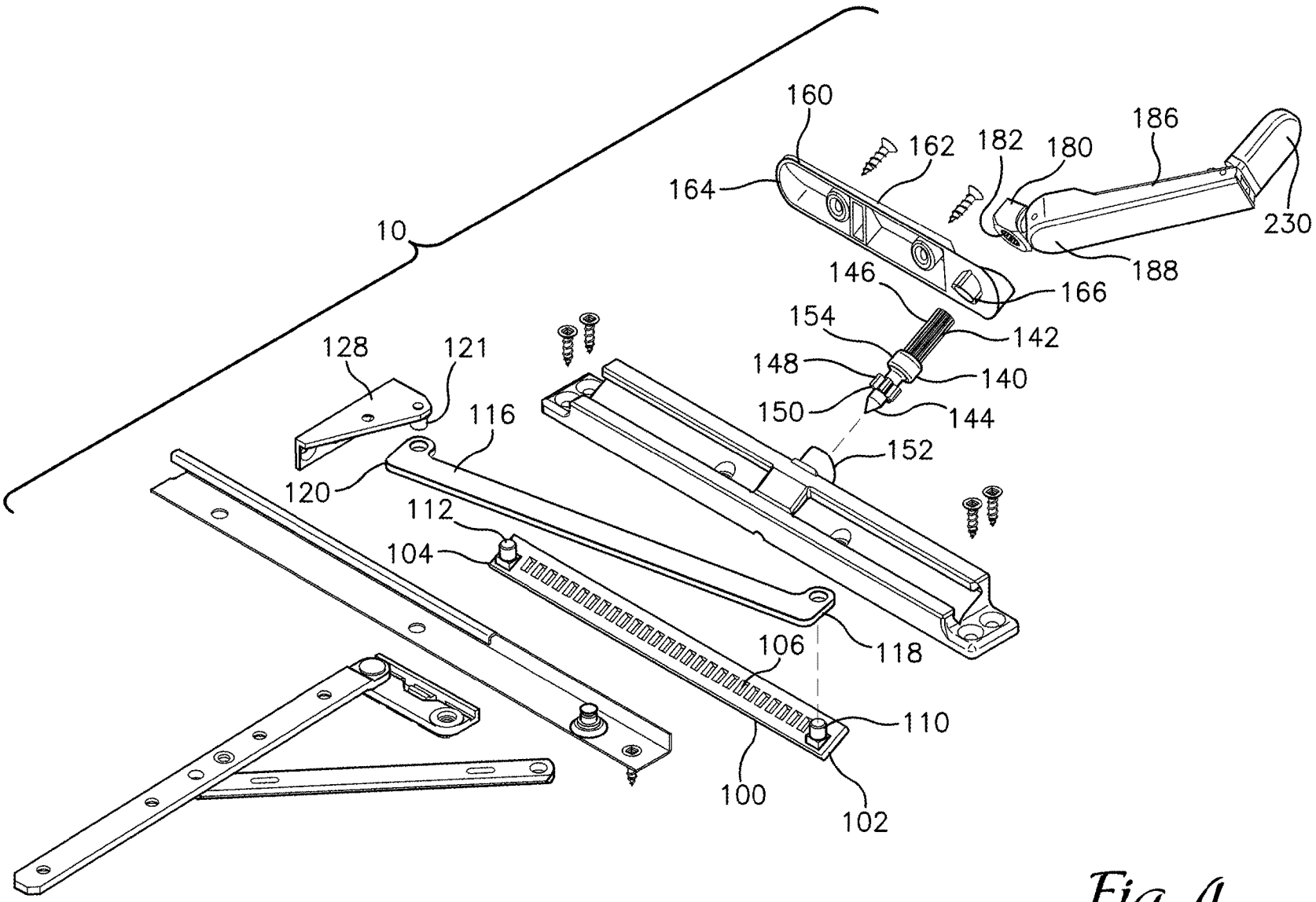
FIG. 4 illustrates an exploded view of casement window operator components, according to an embodiment.

As shown in FIGS. 2 and 4, the casement operator 10 utilizes a rack 100 with a first end 102 and a second end 104 and multiple cutouts 106 along nearly the entire length of the rack. The rack 100 is configured to be translatable in a track 108 secured to the base 34 of the window frame 14. The rack 100 is preferably fabricated from a material such as aluminum or an engineered plastic and, a boss 110, 112 extends upwardly from the first end 102 and the second end 104. FIGS. 2 and 4 also illustrate the operator arm 116 with a first end 118 and a second end 120.

Figure 5:
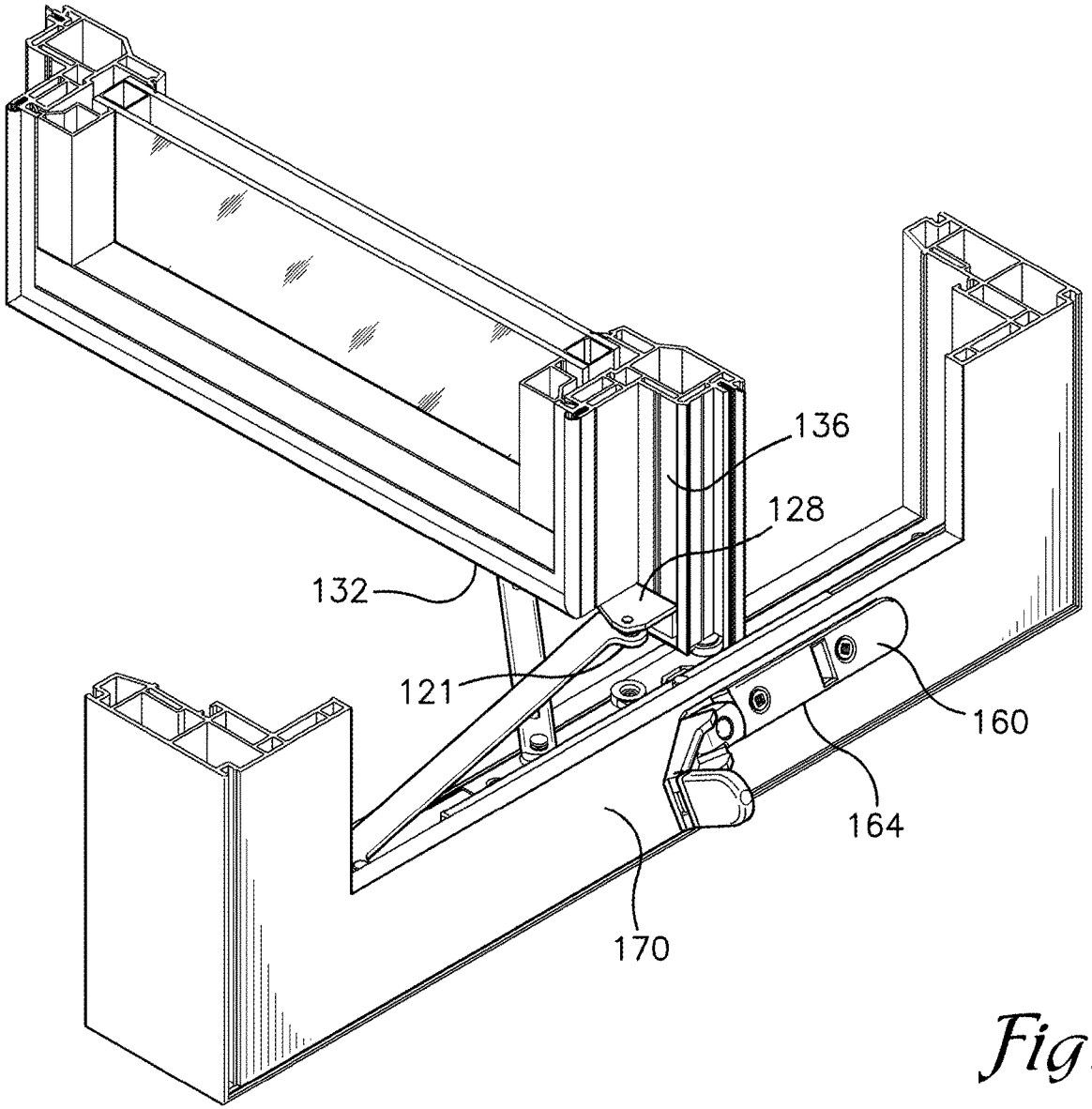
FIG. 5 illustrates a perspective view of the handle portion of the casement window operator, according to an embodiment.

The second end 120 of the operator arm 116 is interchangeably and rotatably connectable to either the first boss 110 on the first end 102 or the second boss 112 on the second end 118 of the rack 110 depending upon the desired swing direction of the sash. The second end 120 of the operator arm 116 is rotatably connected to a downwardly extending boss 121 on the sash bracket 128 which in turn is secured to the sash 16 (not shown in FIG. 2 or 4) with a plurality of threaded fasteners 130. The threaded fasteners secure the bracket 128 to a lower vertical surface 132 of the sash 16 with the boss pivot point 121 of the bracket 128—operator arm 116 connection positioned adjacent a vertical exterior wall 136 of the sash 16 as seen in FIG. 5.

FIGS. 2 and 4 also illustrate a shaft 140 with a first end 142 and a second end 144. The first end 142 of the shaft 140 is preferably splined 146 for receiving an internally splined female component member as will be detailed later. The shaft 140 is preferably fabricated from a metal such as aluminum, or a durable engineered plastic, such as polyvinyl chloride. FIG. 4 reveals a pinion 148 mounted to the shaft 140 proximate the second end 144, wherein the teeth 150 of the pinion 148, in an assembled and operational configuration, engage with the cutouts 106 of the rack 100. Rotation of the shaft 140 and associated pinion 148 imparts movement to the rack 100 which in turn causes the operator arm 116 to move. As will be further detailed below, movement of the rack 100 and operator arm 116 transitions the sash 16 between the window open and the window closed position.

FIG. 4 further illustrates that the splined 146 first end 142 of the shaft 140 extends outwardly from an opening 152 in the window frame 14. The second end 144 of the shaft 140 is inserted into the opening 152 and the pinion gear 148 engages with the cutouts 106 in the rack 100. A collar 154 on the shaft 140 serves to limit the depth of the plunge of the shaft 140 into the opening 152 by interfering with a ledge (not shown) inside of the opening 152.

As shown in FIG. 4, handle cradle 160 has a face side 162, a mounting side 164 and an opening 166 extending between the two sides is shown in FIG. 4. As seen in FIG. 4, the mounting side 164 of the handle cradle 160 is mounted against the vertically oriented base portion 170 of the window frame 14 and preferably has a beveled surface 172 resulting in an upward projection of the shaft 140 thereby limiting interference of the handle 102 with the window sill when the handle 160 is being rotated. The handle cradle 160 is mounted over and aligned with the opening 152 in the window frame 14. Alignment of the cradle opening 166 and the window frame opening 152 allows the shaft 140 to be inserted through the handle cradle 160 and to extend outwardly and upwardly.

Figure 6:
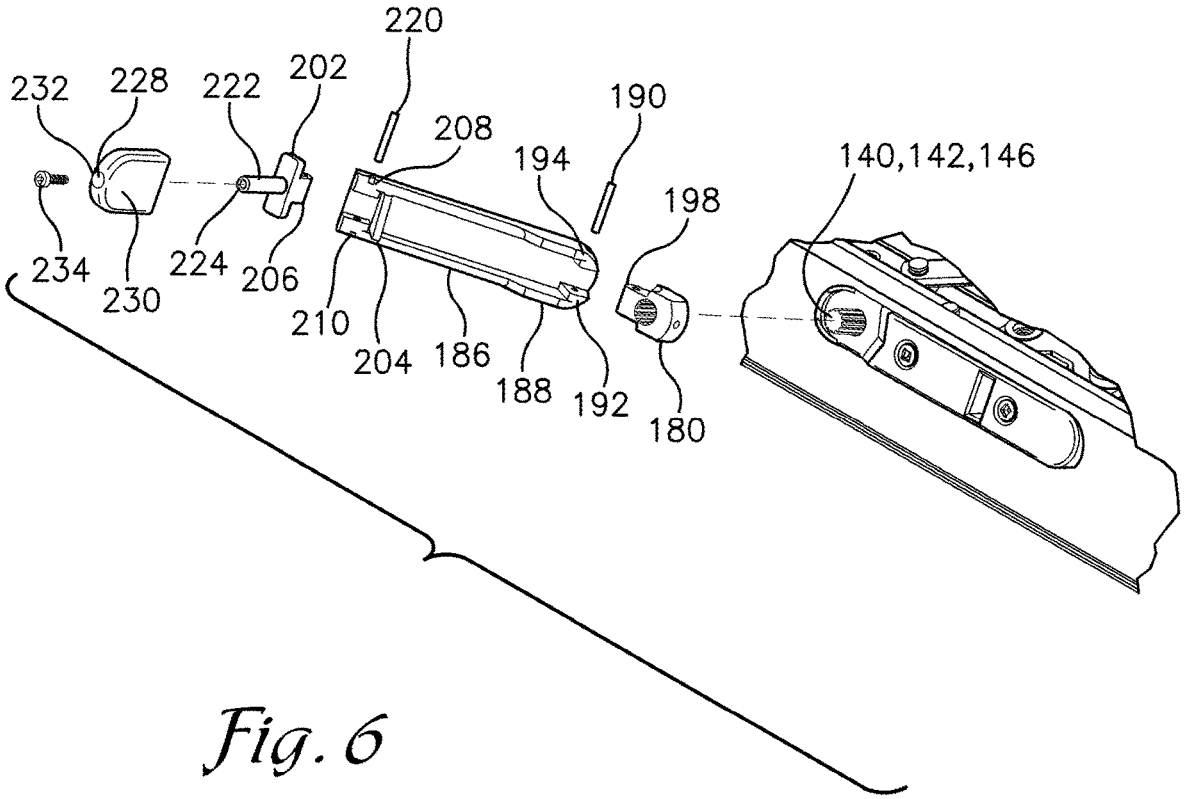
FIG. 6 illustrates a perspective view of the handle assembly of the casement window operator, according to an embodiment.

FIG. 6 illustrates a handle assembly 179 including a handle coupler 180 that is mounted to the first end 142 of the shaft 140. The splines 146 of the first end 142 engage with the internal female splines 182 of the handle coupler 180. The handle coupler 180, as previously detailed, mounts to the first end 142 of the shaft 140 and enhances operational flexibility of the handle 186 during utilization of the casement operator 10. A first end 188 of the handle 186 is pivotally mounted to the handle coupler 180. As illustrated in FIG. 6, a preferred embodiment for pivotal mounting is to use a pin 190 passing laterally through a pair of flanges 192, 194 on the first end 188 of the handle 186 and also passing through a raised extension 198 on the handle coupler 180. The pin 190 secures the flanges 192, 194 to the extension 198 and further facilitates rotation of the handle about the pin.

As also shown in FIG. 6, a T-shaped link 202 is pivotally pinned to the second end 204 of the handle 186. In a preferred embodiment, a main body portion 206 of the T-shaped link 202 is inserted between two flanges 208, 210 at the second end 204 of the handle 186. A pin 220 is then passed through the main body portion 206 of the T-shaped link 202 and the two flanges 208, 210 secure the T-shaped link 202 to the second end 214 of the handle 186. The T-shaped link 202 also includes a cylindrical shaft 222 with a distal end 224. The thumb plate shaft 222 extends outwardly and oppositely from the main body portion 206.

The thumb plate shaft 222 extends through a bore 228 in a thumb plate 230 and extends to a distal end 232 of the thumb plate. The distal end 224 of the cylindrical shaft 222 and the distal end 232 of the thumb plate 230 are coterminous. The thumb plate 230 is rotationally secured in position with a set screw 234 installed at the distal end 224 of the cylindrical shaft 222.

In operation, and starting from a closed window orientation, a human operator unfolds the handle 186 including the thumb plate 230 from the handle cradle 160. Once the handle 186 and thumb plate 230 are elevated off of the cradle 160 the human operator positions the thumb plate 230 in a comfortable orientation allowing the handle to be rotated in the direction to open the window.

Figure 7:
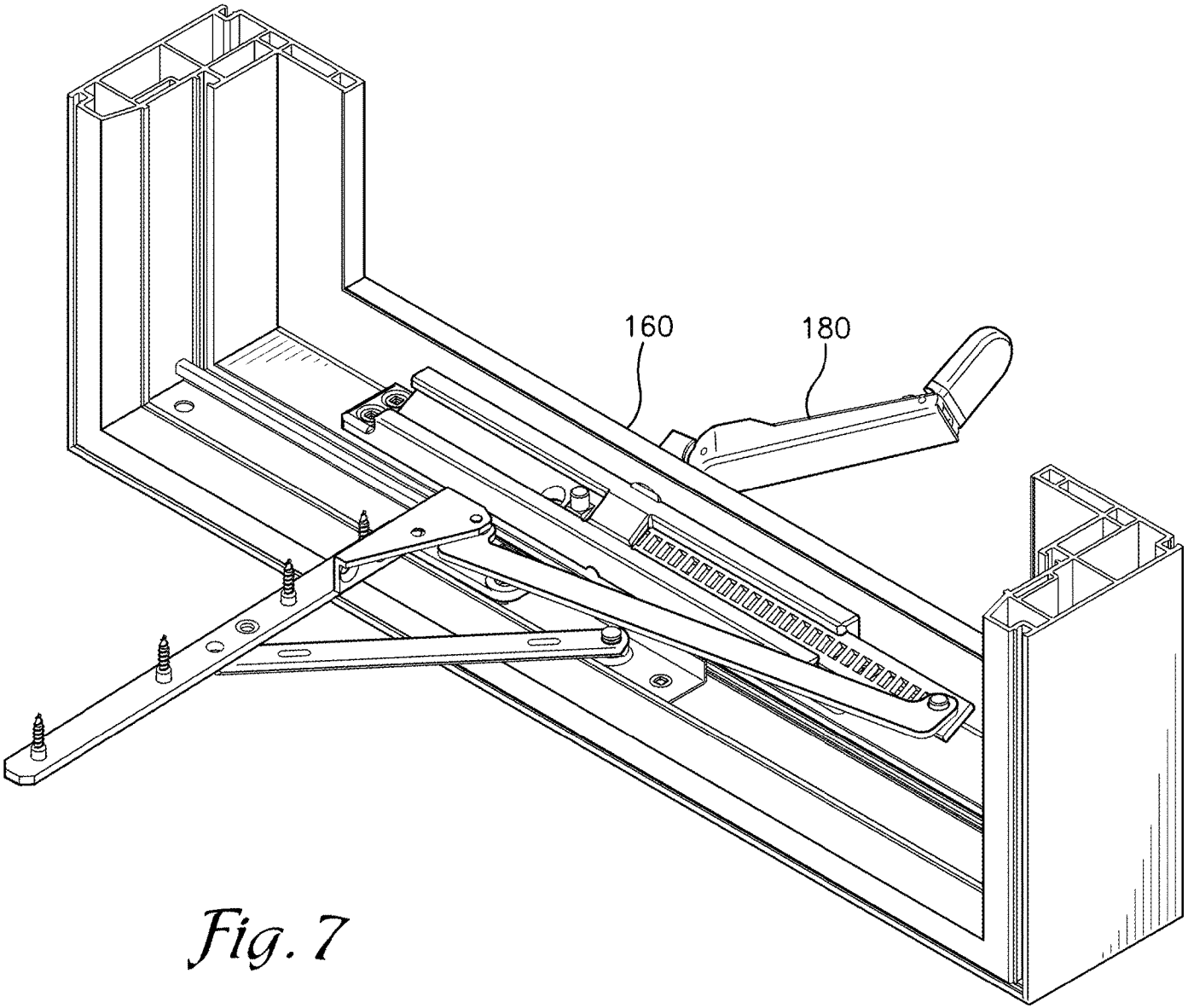
FIG. 7 illustrates a perspective view of the casement window frame and hinge arm hardware, according to an embodiment.

As seen in FIGS. 5-7, the inclination of the handle 186 relative to the cradle 160 can be optimized for the particular user because the first end 188 of the handle 186 is mounted to the handle coupler 180 preferably by a pin 190 passing laterally through the raised pair of flanges 192, 194 of the handle and also passing through a raised extension 198 on the handle coupler 180. This pinned handle configuration in conjunction with the pivotal nature of the thumb plate 230, which is capable of rotation about the cylindrical shaft 222 passing through the thumb plate, optimizes the ergonomic connection between the user and the handle 186.

As the human user rotates the handle 186, in the direction to open the window, the handle coupler 180 which is mounted over the splined shaft 180 and which has its own internal mating spline 182, imparts rotation to the pinion gear 148 which engages with the cutouts 106 in the rack 100 causing movement of the rack 100. The shaft 140 which passes through openings 152, 166 in both the cradle 160 and the window frame 14 maintains positional orientation because of the collar 154 located on the shaft 140 above the pinion gear 148. The collar 154 prevents the shaft 140 from dropping too low into the window frame 14 and provides for precise engagement with the cutouts 106 in the rack 100.

With the pinion gear 148 engaged with the cutouts 106 in the rack 100, the rotation of the pinion gear 148 is transferred to translation of the rack 100 within the track 108 of the window frame 14. As the rack 100 translates within the track 108 of the window frame 14 an opening 122 in the first end 118 of the operator arm 116 is mounted to the boss 110 of the first end 102 of the rack 100. The second end 120 of the operator arm 116 is secured to a sash bracket 128 as seen in FIG. 2. As the rack 100 translates and in turn moves the operator arm 116 the upper and lower hinge shoes 72, 28 slidably mounted onto the oppositely disposed hinge tracks 30, 74, as seen in FIGS. 2 and 3 also begin to translate causing the sash 16 to rotate inwardly or outwardly depending upon the direction of rotation of the handle 186.

When moving the sash 16 into a fully open position, the translation of the rack 100 pulls the operator arm 116 which is connected to the sash bracket 128 which in turn causes the upper and lower hinge shoes 70, 28 to slide atop the hinge tracks 30, 74. Turning the handle 168 the opposite direction, causing the window to close, simply reverses the movement. The rack 100 reverses direction and causes the operator arm 116 to push on the sash brackets 154, 128. The sash brackets then transfers the force from the operator arm 116 to the sash 16 causing the hinge shoes 28, 70 to slide, or translate, atop their respective hinge tracks 30, 74 eventually returning the vertical panel 272 of the sash 16 to contact the window frame 14 and allowing the opposite vertical panel 274 of the sash 16 to come into contact with the opposite window frame member.

Having shown and described various embodiments of the present invention, further adaptations of the apparatus described herein may be accomplished by appropriate modifications by one of ordinary skill in the art without departing from the scope of the present invention. Potential modifications will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings. Moreover, the order of the components detailed in the system may be modified without limiting the scope of the disclosure.

I claim:

1. A casement operator for a window having a window frame and a sash operable between a window closed position in which the sash is received in the frame and a window open position in which the sash is swung outwardly from the frame, the casement operator comprising:

a rack with a first end and a second end, the rack slidable in a track disposed within the window frame;

an operator arm with a first end and a second end, the first end of the operator arm interchangeably and rotatably connectable to either the first end or the second end of the rack depending upon a desired swing direction of the sash, the second end of the operator arm rotatably connected to the sash;

a shaft with a first end and a second end; and a pinion mounted to the shaft proximate the second end, wherein the pinion operably engages with the rack, and pinion rotation imparts movement to the rack and the operator arm, said rack and operator arm movement capable of transitioning the sash between the window open and the window closed position.

2. The casement operator of claim 1, wherein the second end of the shaft extends outwardly from an opening in the window frame.

3. The casement operator of claim 2, further comprising a handle cradle with a face side, a mounting side and a through hole extending between the two sides.

4. The casement operator of claim 3, wherein the mounting side is beveled.

5. The casement operator of claim 4, wherein the mounting side is mounted against the window frame.

6. The casement operator of claim 5, wherein the through hole is mounted over the shaft extending outwardly from the window frame.

7. The casement operator of claim 6, wherein a handle coupler is mounted to the first end of the shaft.

8. The casement operator of claim 7, wherein the handle coupler is a splined coupler.

9. The casement operator of claim 8, wherein a first end of a main handle member is pivotally mounted to the handle coupler.

10. The casement operator of claim 9, wherein a T-shaped link is pivotally pinned to the second end of the main handle member.

11. The casement operator of claim 10, wherein the T-shaped link further comprises a cylindrical shaft with a distal end, the shaft extending outwardly from the T-shaped link.

12. The casement operator of claim 11, wherein the cylindrical shaft extends through an opening in a distal end of a thumb plate.

13. The casement operator of claim 12, wherein the distal end of the cylindrical shaft and the distal end of the thumb plate are coterminous.

14. The casement operator of claim 13, wherein the thumb plate is secured in position with a set screw installed at the distal end of the cylindrical shaft.

15. The casement operator of claim 14, wherein the rack driven by the pinion shifts position along the track.

16. A window operator for a window having a window frame and a movable window sash, the window operator comprising:

a rack with oppositely disposed first and second ends, the rack disposed within a track within the window frame, the rack being moveable within the track and the rack having a boss extending upwardly from each of the first and second ends;

an operator arm with first and second ends, the operator arm connectable between a sash bracket at the second end, and the boss extending upwardly from the first end of the rack, the sash bracket in turn mounted to the window sash;

a hinge arm rotationally mounted to a hinge shoe, wherein the hinge shoe is disposed upon a hinge track, wherein the hinge track comprises an overhanging flange forming a longitudinally extending channel, an upwardly extending flange on the hinge shoe is received into the longitudinally extending channel and slidably secured therein;

a shaft with a first end and a second end;

a handle mounted to the first end of the shaft; and a pinion mounted to the shaft proximate the second end, wherein the pinion operably engages with the rack, and rotation of the shaft by the handle imparts movement to the rack and the operator arm, said rack and operator arm movement capable of transitioning the sash between a window open and a window closed position.

17. The window operator of claim 16, wherein the rack further comprises a plurality of cutouts for engagement with the pinion.

18. The window operator of claim 16, wherein a second end of a support arm is rotatably secured to a riser at a second end of the hinge track.

19. The window operator of claim 18, wherein a first end of the support arm is rotatably secured to roughly a midpoint of a hinge arm.

* * * * *